United States Patent [19]

Hwang

[11] Patent Number: 4,908,741

[45] Date of Patent: Mar. 13, 1990

[54] DESK LAMP-CONVERTIBLE PENCIL BOX

[76] Inventor: Kuo H. Hwang, 115, Kuo Tze Lih, Pei Twen District, Taichung, Taiwan

[21] Appl. No.: 359,966

[22] Filed: Jun. 1, 1989

[51] Int. Cl.[4] ..... F21V 33/00

[52] U.S. Cl. ..... 362/154; 362/234; 362/421; 362/287

[58] Field of Search ..... 362/33, 154, 234, 249, 362/250, 251, 253, 283, 287, 419, 427, 421, 156; 211/69.1

[56] References Cited

U.S. PATENT DOCUMENTS 4,751,620 6/1988 Wright et al. ..... 362/154 X

*Primary Examiner*—Stephen F. Husar

*Attorney, Agent, or Firm*—Asian Pacific Int'l Patent and Trademark Office

[57] ABSTRACT

A pencil box which can be converted into a desk lamp, including a box seat, a box cover and a pivot member connecting the box cover to the box seat, the box seat having two battery containers and the box cover having two lamp sockets connected to the battery containers via a set of wires which are disposed on the box seat and through the pivot member to form a circuit, a switch being further disposed on the box cover to control the circuit, whereby when batteries and lamps are installed respectively in the battery containers and lamp sockets, the lamps can be lighted up via the switch with the box cover pivoted upward to convert the pencil box into a desk lamp.

2 Claims, 4 Drawing Sheets

DESK LAMP-CONVERTIBLE PENCIL BOX

BACKGROUND OF THE INVENTION

A pencil box is conventionally used by most of common students. It is often placed on a desk for the convenience of taking and using the stationeries contained therein. However, when a pencil box is used in a place lacking sufficient illumination, an additional lamp device may be required to light up the place. When such a lamp device is not available, it will become a task to normally write or read.

It is therefore tried by the applicant to deal with the above problem and try to develop a new pencil box which can be converted into a desk lamp to perform both functions of a pencil box and a desk lamp when used in a somewhat dim place.

The present invention can be best understood through the following description and accompanying drawings wherein:

DETAILED DESCRIPTION OF THE PRESENT INVENTION

Figure 1:
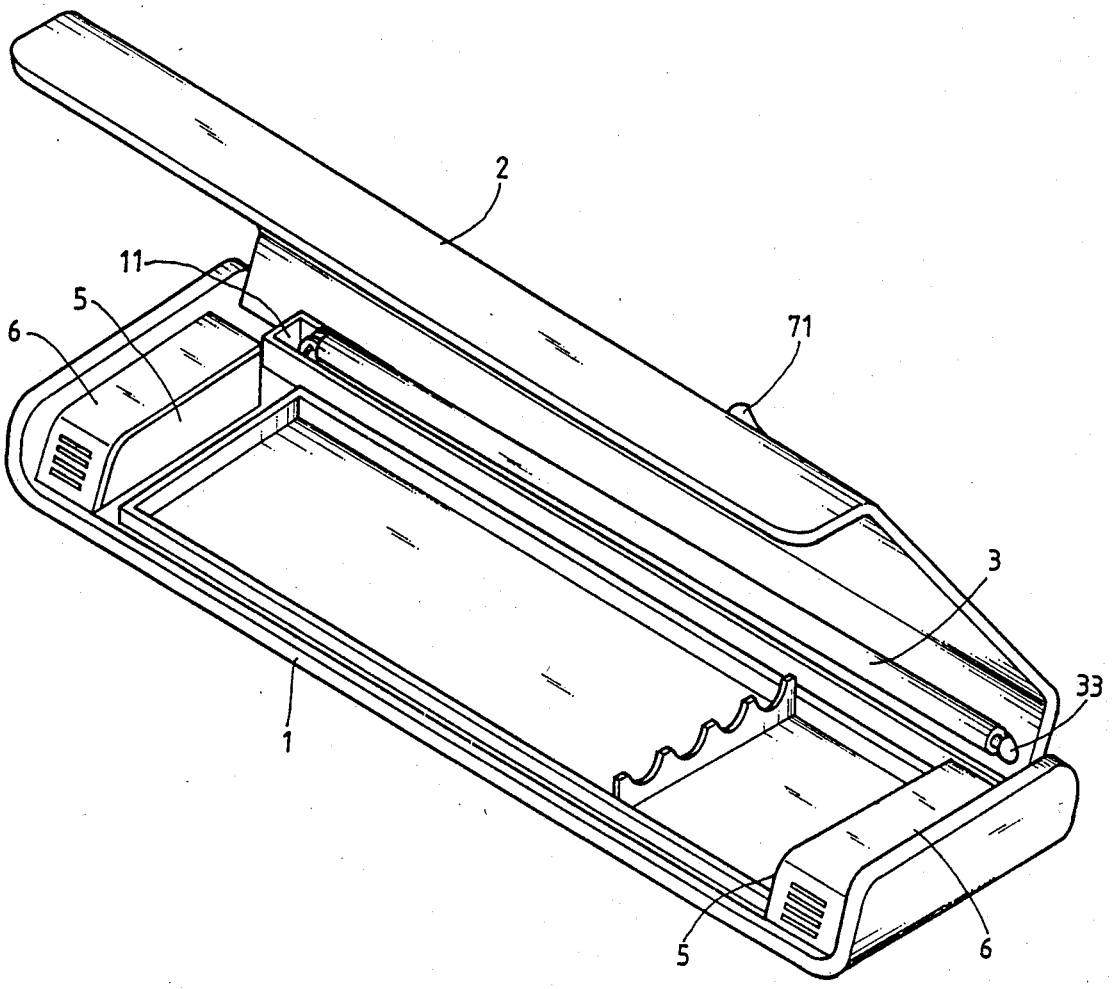
FIG. 1 is a perspective view of the present invention in a pencil box state.
Figure 2:
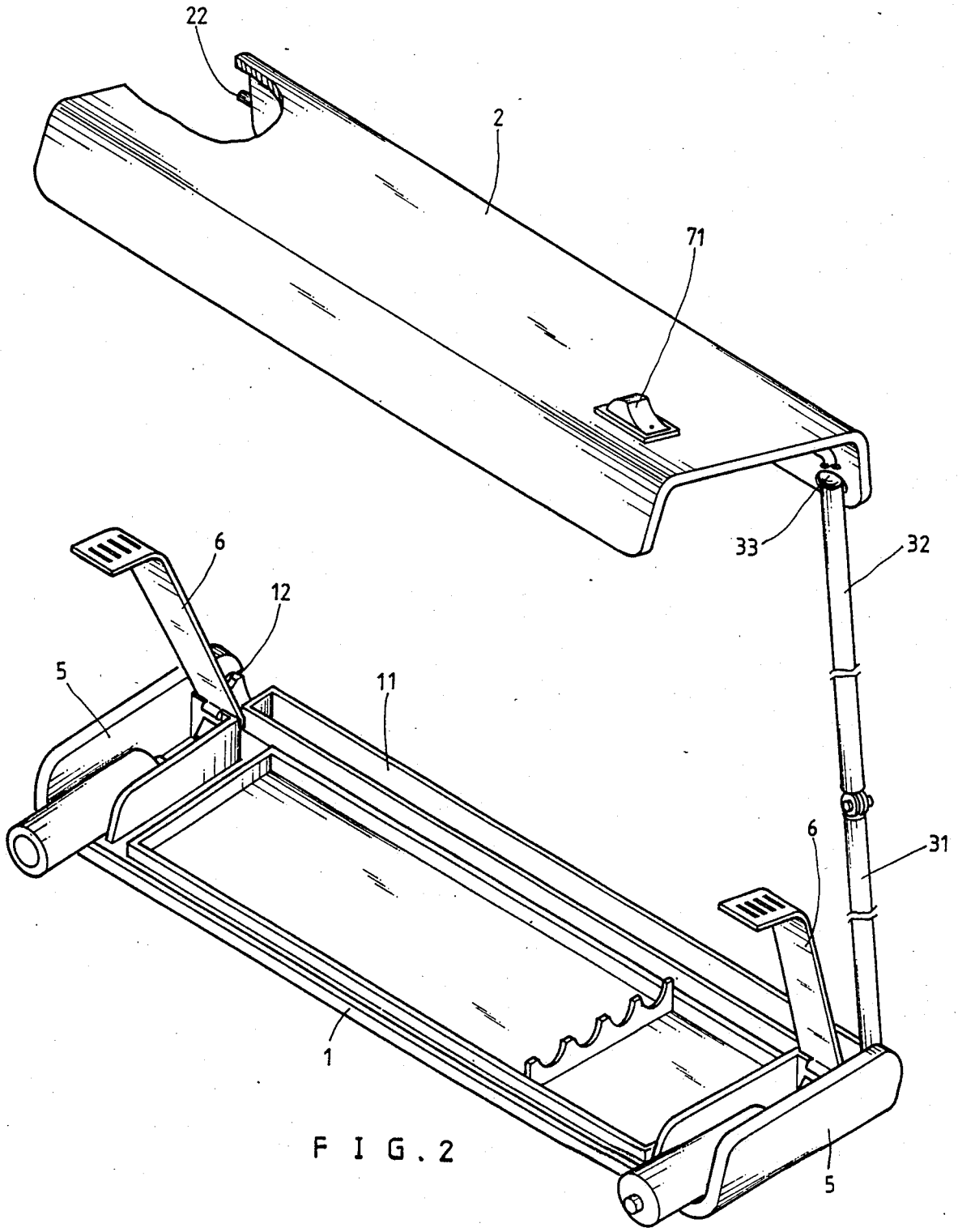
FIG. 2 is a perspective view of the present invention in a desk lamp state.
Figure 3:
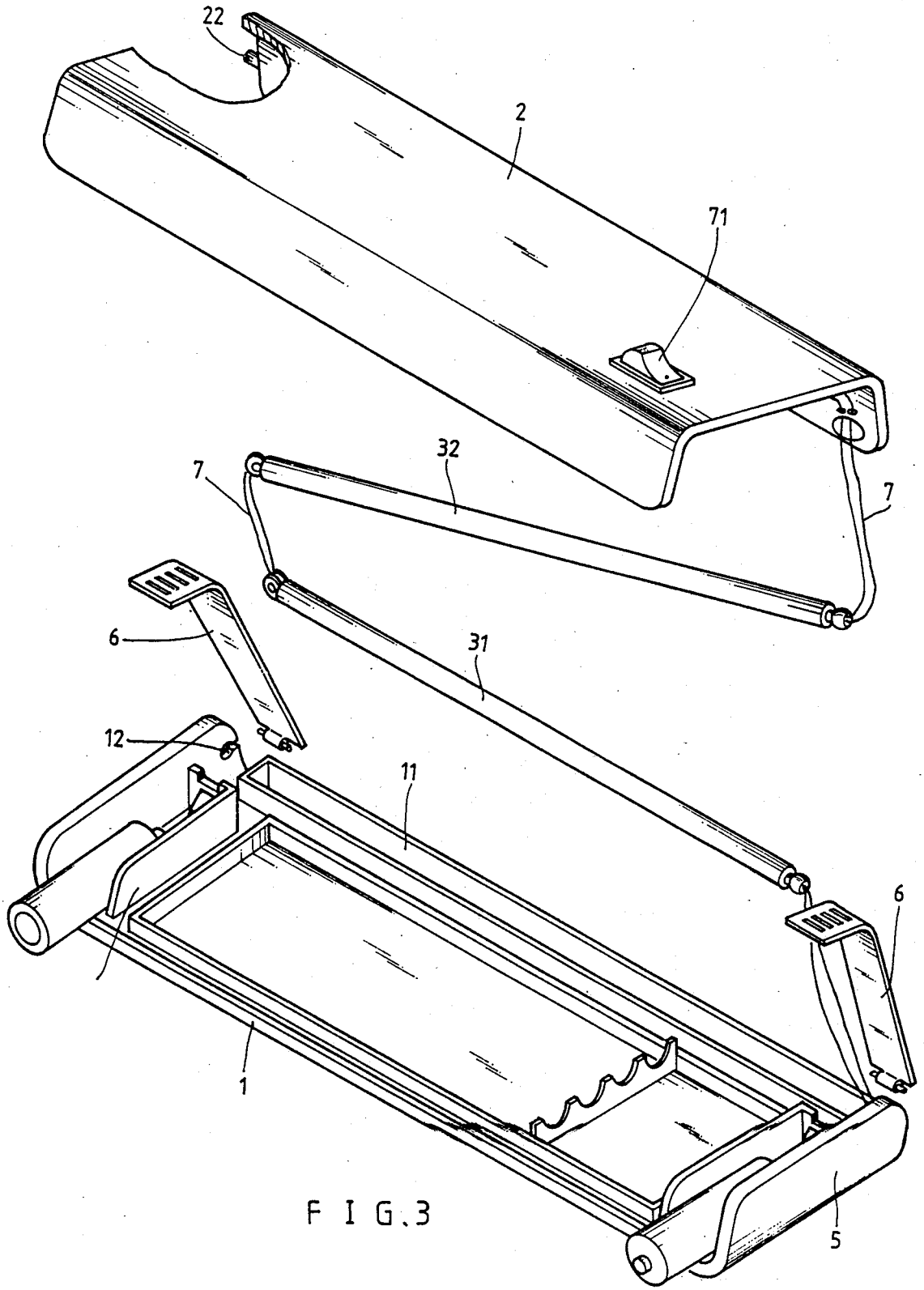
FIG. 3 is an exploded view of the present invention.
Figure 4:
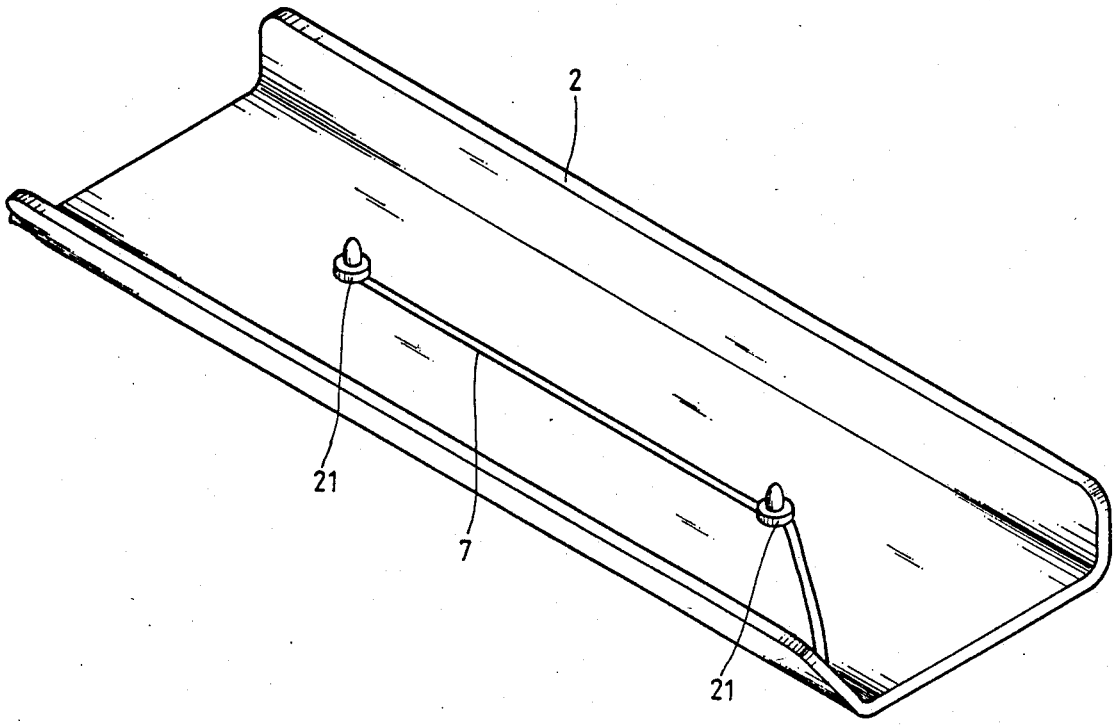
FIG. 4 shows the lamps and wires connecting the lamps to the batteries.

Please refer to FIG. 1. The present invention includes a box seat 1, a box cover 2, and a pivot member 3. Referring to FIG. 2, on its left and right sides, the box seat 1 has two battery containers 5 each having a cap member 6 pivoted thereto. A long groove 11 is located along the rear side of the box seat 1.

The pivot member 3 has a first pivot rod 31 pivoted to right end of the groove 11, and a second pivot rod 32 in turn pivoted to the first pivot rod 31. On its light side, the box cover 2 is further pivoted to the second pivot rod 32 via a ball joint 22. Two lamp sockets 21 are located on the lower surface of the box cover 2.

A set of wires 7 are disposed along the front side and rear side of the box seat 1 and through the pivot member 3 to electrically connect the anodes and cathodes of the battery containers 5 with the lamp sockets 21 of the box cover 2 to form a circuit. A switch 71 is further disposed on the box cover 2 to control the opening and closing of the circuit.

Therefore, when batteries 4 and lamps 8 are installed respectively in the battery containers 5 and lamp sockets 21, the lamps 8 can be lighted up via the switch 71 with the box cover 2 pivoted upward to convert the pencil box into a desk lamp.

The long groove 11 located along the rear side of the box seat 1 is suitable for receiving the pivot member 3. A hinge recess 12 is formed at the left end of the groove 11, and a corresponding hinge protuberance 22 is formed on the left side of the box cover 2 whereby when the box 30 cover 2 is pivoted downward with the pivot member 3 folded up and received in the groove 11, the hinge protuberance 22 can be rotarily fitted in the hinge recess 12, permitting the box cover 2 to rotate about the pivot member 3 and serve as a pencil box cover.

According to the above arrangement, the present invention can be alternatively used as a pencil box or a desk lamp.

Many variations within the scope of the appended claims will be apparent to those skilled in the art once the principles described herein are understood.

I claim:

1. A desk lamp-convertible pencil box comprising:

a box seat;

a box cover; and a pivot member having a first pivot rod and a second pivot rod, said first pivot rod being pivoted to said box seat and said second pivot rod pivotally connecting said first pivot rod to said box cover, said box seat having two battery containers and a long groove for receiving said pivot member, said box cover having lamp sockets, and a set of wires being disposed on said box seat and through said pivot member to electrically connect said battery containers and lamp sockets to form a circuit, a switch being further disposed on said box cover to control the opening and closing of the circuit, whereby when batteries and lamps are installed respectively in the battery containers and lamp sockets, the lamps can be lighted up via said switch with said box cover pivoted upward to convert the pencil box into a desk lamp.

2. A desk lamp-convertible pencil box as claimed in claim 1, wherein said battery containers are respectively disposed on two sides of said box seat, each having a cap member pivoted thereto, and said long groove is provided with a hinge recess at its one end, said box cover being provided with a corresponding hinge protuberance whereby when said box cover is pivoted downward with said pivot member folded up and received in said long groove, said hinge protuberance can be rotarily fitted in said hinge recess, permitting said box cover to rotate about said pivot member and serve as a pencil box cover.

* * * * *